US008579666B2

(12) United States Patent
Lampert et al.

(10) Patent No.: US 8,579,666 B2
(45) Date of Patent: Nov. 12, 2013

(54) CONTACT ELEMENT WITH AN ELECTRONICALLY CONDUCTIVE SPRING ELEMENT, PLUG CONNECTOR AND SPRING ELEMENT

(75) Inventors: Zoltan Lampert, Troisdorf (DE); Thomas Schnurpfeil, Meckenheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 20 days.

(21) Appl. No.: 13/256,887

(22) PCT Filed: Mar. 15, 2010

(86) PCT No.: PCT/EP2010/053245

§ 371 (c)(1),
(2), (4) Date: Sep. 15, 2011

(87) PCT Pub. No.: WO2010/105998

PCT Pub. Date: Sep. 23, 2010

(65) Prior Publication Data

US 2012/0003884 A1 Jan. 5, 2012

(30) Foreign Application Priority Data

Mar. 16, 2009 (DE) ..... 10 2009 001 573

(51) Int. Cl.
*H01R 13/187* (2006.01)

(52) U.S. Cl.
USPC ..... 439/843

(58) Field of Classification Search
USPC ..... 439/843, 827
See application file for complete search history.

(56) References Cited

U.S. PATENT DOCUMENTS

| | | | | |
|---|---|---|---|---|
| 4,106,839 | A * | 8/1978 | Cooper | 439/607.18 |
| 4,714,441 | A | 12/1987 | Corman | |
| 6,332,815 | B1 * | 12/2001 | Bruce | 439/862 |
| 6,435,917 | B1 | 8/2002 | McDonald et al. | |
| 7,587,244 | B2 * | 9/2009 | Olbertz | 607/37 |
| 8,057,369 | B1 * | 11/2011 | Salach | 482/111 |
| 8,128,416 | B2 * | 3/2012 | Lenhert | 439/32 |
| 2001/0055908 | A1 | 12/2001 | Bruce | |

FOREIGN PATENT DOCUMENTS

| | | | |
|---|---|---|---|
| DE | 544104 | | 2/1932 |
| DE | 2443471 | A1 | 9/1974 |
| DE | 102004002404 | B3 | 9/2005 |
| EP | 0202564 | A2 | 11/1986 |
| FR | 2667451 | A1 | 4/1992 |
| FR | 2778276 | A1 | 11/1999 |
| GB | 1179975 | | 2/1970 |

OTHER PUBLICATIONS

International Preliminary Report on Patentability, issued by the International Bureau of WIPO, Geneva, Switzerland, dated Sep. 20, 2011, for related International Application No. PCT/EP2010/053245; 5 pages.

International Search Report and Written Opinion issued by the European Patent Office, dated Apr. 20, 2010, for PCT/EP2010/053245; 12 pages.

Search Report issued by the German Patent & Trademark Office, dated Mar. 16, 2009, for Priority Application No. DE 102009001573.6; 5 pages.

* cited by examiner

*Primary Examiner* — Phuong Dinh
(74) *Attorney, Agent, or Firm* — Faegre Baker Daniels LLP

(57) ABSTRACT

The invention relates to a spring element, to a plug-in connection and to a contact element with an electrically conductive spring element which is in contact with the contact element and which is provided to establish an electrical contact to a mating contact element. The spring element has the form of an open band which is at least partially rolled up along a longitudinal axis.

9 Claims, 8 Drawing Sheets

CONTACT ELEMENT WITH AN ELECTRONICALLY CONDUCTIVE SPRING ELEMENT, PLUG CONNECTOR AND SPRING ELEMENT

The invention relates to a contact element according to claim 1, to a plug-in connection according to claim 13 and to an electrically conductive spring element according to claim 14.

It is known in the art to use electrically conductive spring elements to establish an electrically conductive connection between two contacts.

The object of the invention consists in providing an improved contact element, an improved plug-in connection and an improved spring element.

The object of the invention is achieved by the contact element according to claim 1, the plug-in connection according to claim 13 and the electrically conductive spring element according to claim 14.

An advantage of the spring element consists in the fact that its form establishes an improved electrical and/or mechanical contact between the contact element and the mating contact element.

The formation of the spring element in the form of an open band which is at least partially rolled up along a longitudinal axis allows relatively large production tolerances between the contact element and the mating contact element to be compensated for. The described spring element is particularly suitable for the transmission of high currents.

Further advantageous embodiments of the invention are disclosed in the dependent claims.

In one embodiment, the longitudinal axis of the spring element is embodied in a straight or arched, in particular at least partially circular manner. It is thus possible to provide, on account of the partly rolled-up band form, various embodiments of longitudinal axes and thus various embodiments of spring elements. In this way, a broad range of contours of contact elements can be safely and reliably electrically and mechanically contacted with corresponding mating contact elements.

In a further embodiment, the band has recesses which increase the flexibility of the band. This allows improved adaptation of the contour of the spring element to the contact element and/or to the mating contact element. In addition, the recesses provide a plurality of possible contact points allowing relatively extensive electrical contacting between the contact element and the mating contact element.

In a further embodiment, the spring element has along a first and/or a second longitudinal edge first and/or second slots which are formed in an open manner in the direction toward the first or the second longitudinal edge. This provides a flexible structure of the spring element in the contact region.

In a further embodiment, the first slots are formed so as to be shorter than the second slots. In this way, different rigidities are generated at the longitudinal edges in the band, thus allowing optimised adaptation to a circular longitudinal axis with improved contact force between the contact element and the mating contact element.

In a further embodiment, third slots are formed, allowing a further increase in the flexibility and elasticity of the spring element. In this way, in a region between the first and the second longitudinal edge, the arrangement of the third recesses allows increased flexibility and elasticity for a circular shape of the rolled band, the third slots being arranged on an outer side of the circular spring element.

In a further embodiment, the spring element is rolled around the longitudinal axis in such a way that the first longitudinal edge has a greater spacing from the longitudinal axis than does the second longitudinal edge, and the band having a gap in the region of the longitudinal edges. This embodiment allows the spring element to be compressed relatively intensively in the direction toward the longitudinal edge without the two longitudinal edges becoming jammed together. It is thus possible for large intermediate spaces between the contact element and the mating contact element to be bridged with the aid of the spring element.

In a further embodiment, a groove, in which the spring element is at least partially arranged, is provided on the contact element or on the mating contact element. This allows a safe and reliable arrangement of the spring element on the contact element or on the mating contact element. It is thus not possible for the spring element to slip in relation to the contact element or the mating contact element, as a result of which plugging-together of the contact element with the mating contact element is simplified.

The spring element according to the invention is particularly suitable for a plug-in connection, the spring element providing an electrically conductive connection between a contact element and a mating contact element.

The form of the rolled band allows the spring element to be made economically from a punched part.

The invention will be described hereinafter in greater detail with reference to the drawings, in which.

Figure 1:
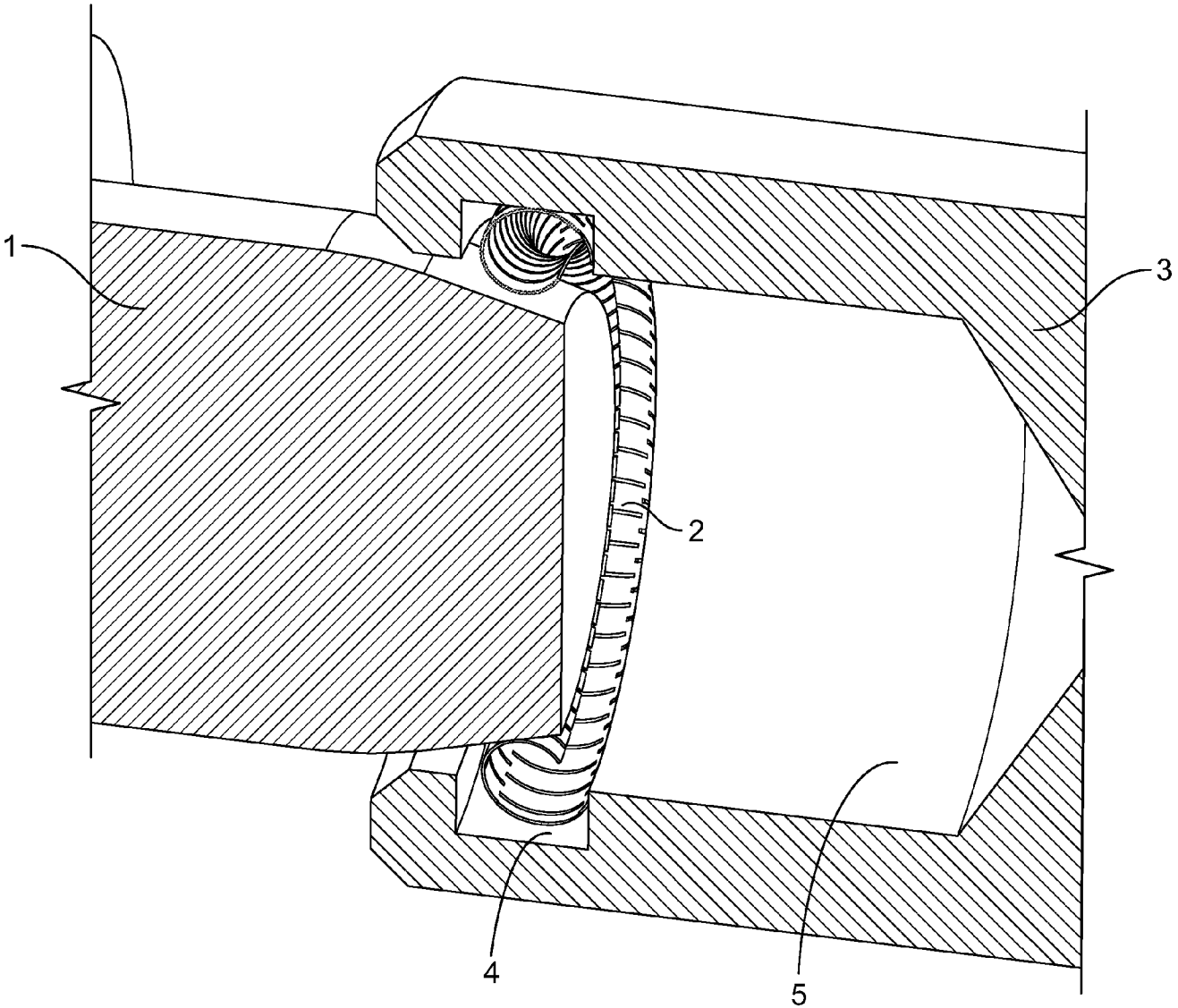
FIG. 1 is a schematic illustration of a partial detail of a plug connector.

FIG. 1 is, in a schematic illustration, a cross section through a part of an electric plug connector with a pin contact 1 and a socket contact 3, the pin contact 1 being partly plugged into the socket contact 3. In the socket contact 3, an annular groove 4, in which a spring element 2 is arranged, is formed on the inner side. The spring element 2 serves to improve the electrical and/or mechanical contacting between the pin contact 1 and the socket contact 3. The pin contact 1 and the socket contact 3 are a contact element and an associated mating contact element. When the pin contact 1 is plugged in, the spring element 2 is clamped between the socket contact 3 and the pin contact 1.

Figure 2:
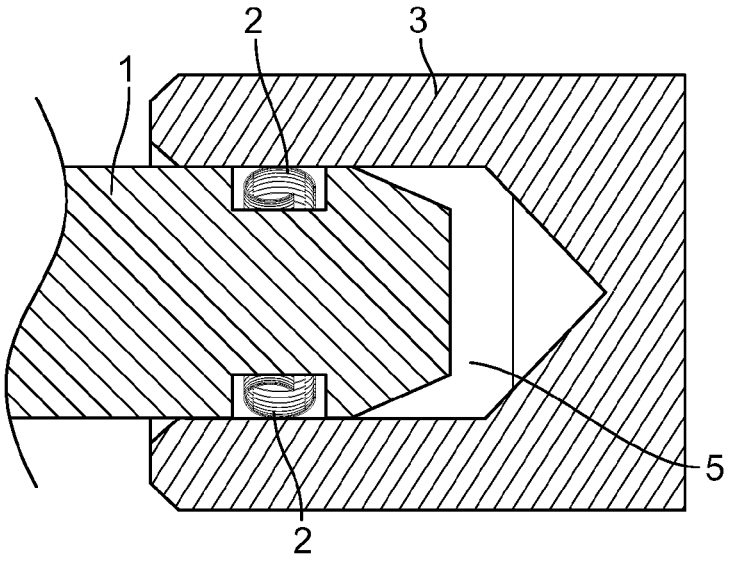
FIG. 2 shows a further embodiment of a plug connector.

FIG. 2 shows a second embodiment in which the peripheral groove 4 is formed in the outer wall of the pin contact 1. In this embodiment, the spring element 2 is arranged in the groove 4 of the pin contact 1. In the embodiments of FIGS. 1 and 2, the recess of the socket contact 3 is cylindrical. In a corresponding manner, the pin contact 1 also has the form of a cylinder.

Figure 3:
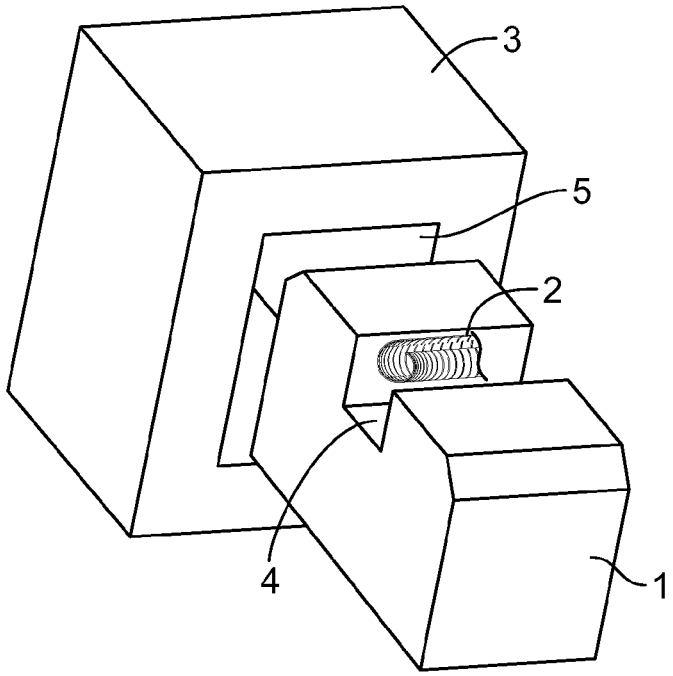
FIG. 3 shows a third embodiment of a plug connector.

However, the application of the new spring element 2 is not limited to these forms of the contact elements and mating contact elements, but can also be applied to other forms such as e.g. rectangular pin contacts 1, such as is illustrated in FIG. 3. In this embodiment, the pin contact 1 is in cross section rectangular, a groove 4 being formed on an upper side of the pin contact 1. A sleeve-filler spring element 2 is positioned in the groove 4. When the pin contact 3 is inserted into a correspondingly parallelepiped shaped recess 5 of the associated socket contact 3, the spring element 2 is clamped between an upper inner wall of the socket contact 3 and the groove 4 of the pin contact 1.

Figure 4:
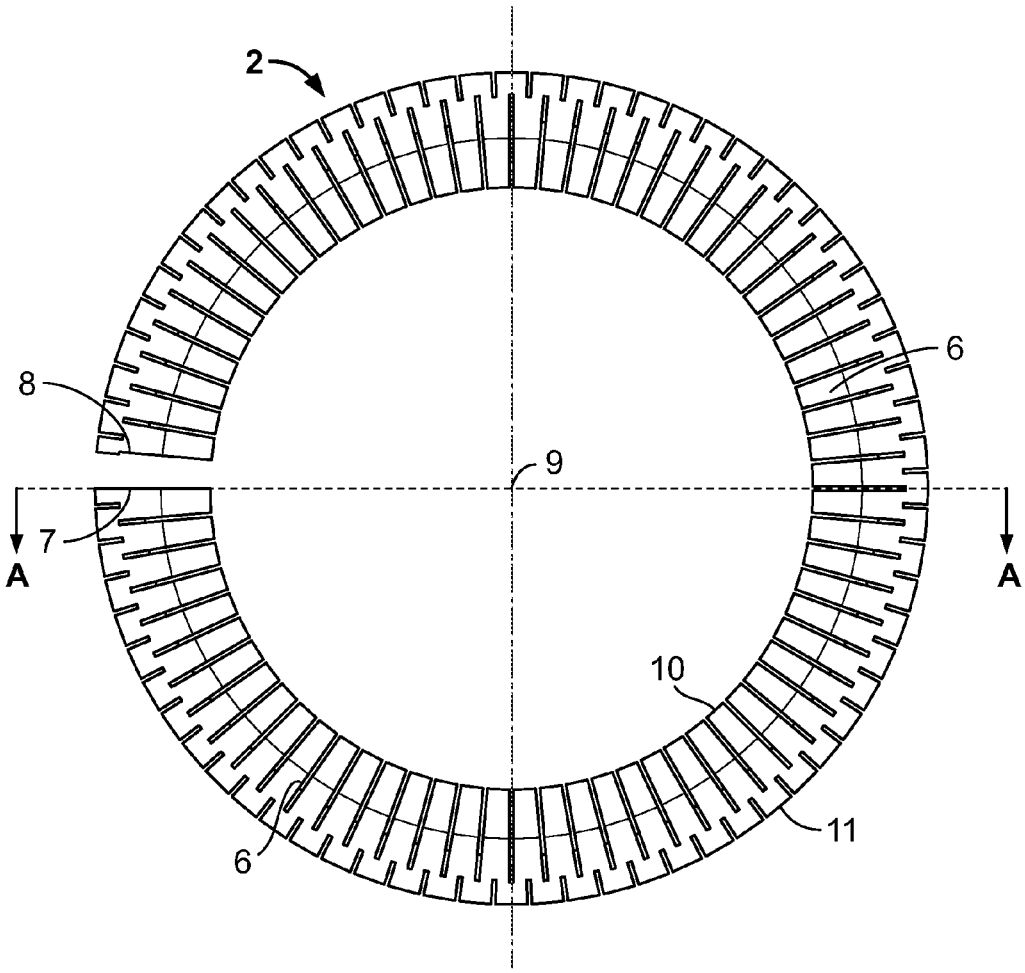
FIG. 4 is a plan view onto the spring element.

FIG. 4 is a plan view of the embodiment of the spring element 2 of FIGS. 1 and 2. The spring element 2 has a central longitudinal axis 6 which is arched in a circular manner. Two ends 7, 8 of the spring element 2 face each other, an angular spacing of from 1 to 10 degrees being provided between the two ends 7, 8 in relation to a centre point 9 of a circle of the spring element in the illustrated embodiment. The spring element 2 is made from an electrically conductive and resilient material, for example a spring steel in the form of a punching sheet which has been rolled and bent. On account of the open form both in the direction of the longitudinal axis and perpendicularly thereto, the diameter of the spring element 2 can be adapted as a result of the compressing to a corresponding outer contour of a pin contact 1 and/or an inner contour of a socket contact 3.

Depending on the embodiment selected, the groove 4 may be dispensed with and the spring element 2 can simply be inserted between a cylindrical pin contact 1 and a recess 5 of a socket contact 3.

Furthermore, the groove 4 may be embodied in the form of a circular ring or in the form of a spiral. As the spring element 2 is embodied in a flexible manner, the spring element 2 can also be adapted to a spiral-shaped groove 4 in the contour. In this embodiment, the first and second ends 7, 8 do not face each other directly, but are arranged in a laterally offset manner, the spring element 2 then also having the form of a partial spiral.

Figure 5:
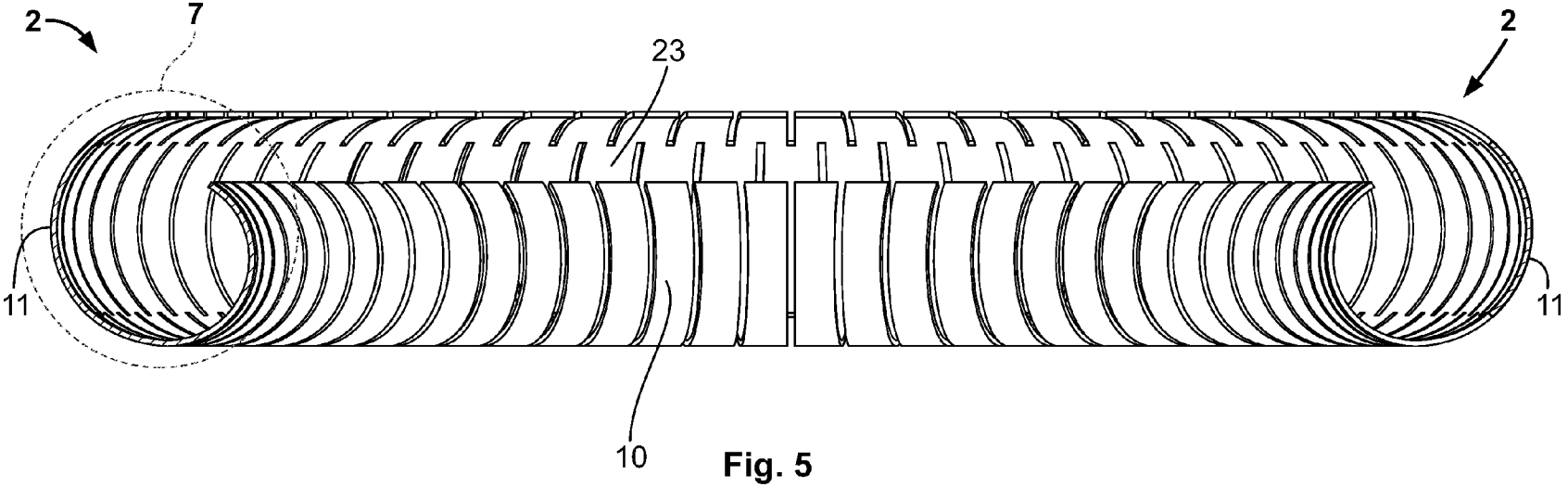
FIG. 5 is a perspective illustration through a central region of the spring element.

FIG. 5 is the cross section A-A from FIG. 4, wherein a semicircle of the spring element 2 is illustrated and wherein the partly open sleeve shape of the spring element 2 with the gap 23 may be seen.

Figure 6:
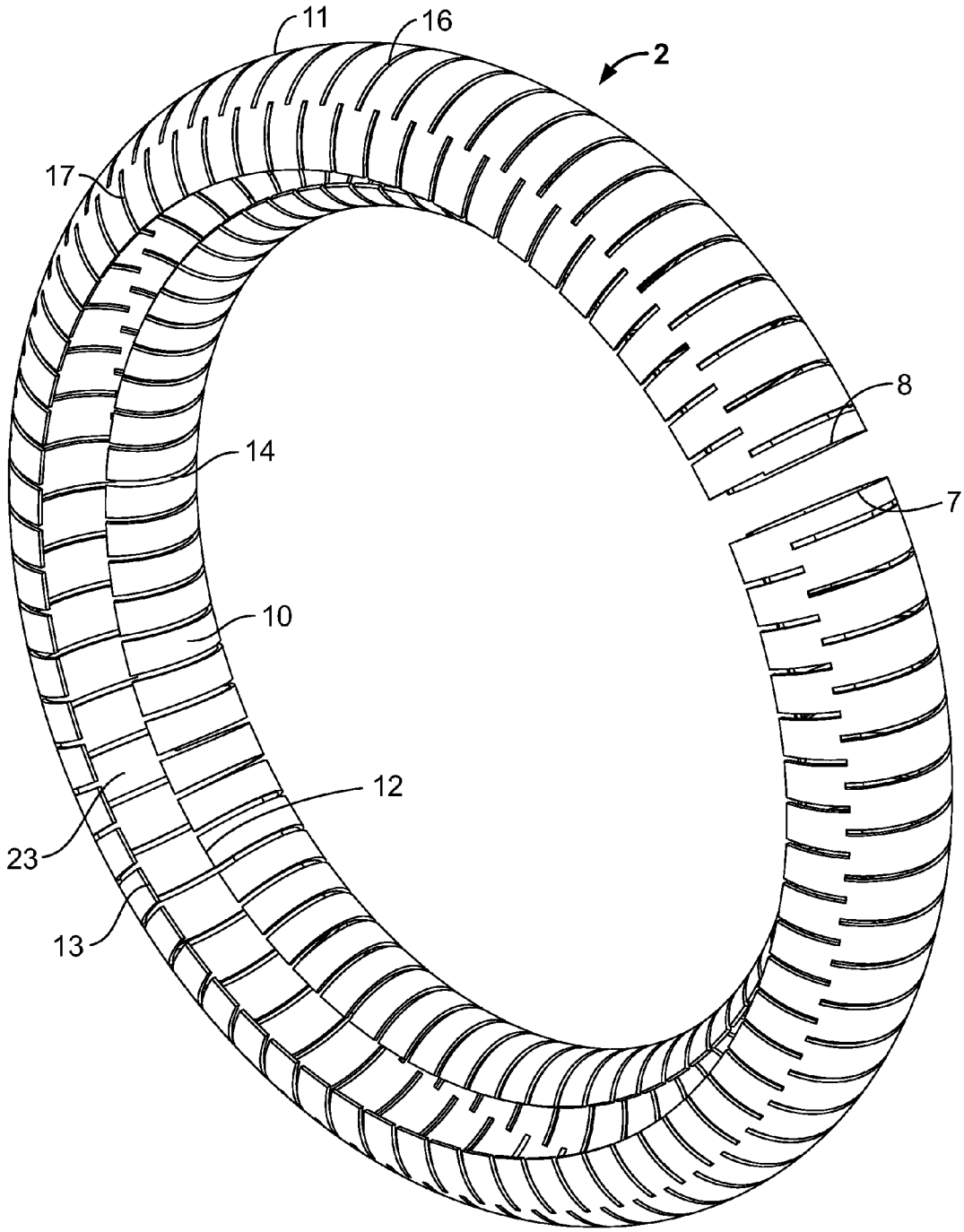
FIG. 6 is a second perspective illustration of the spring element.

FIG. 6 is a further perspective illustration of the spring element from FIG. 4.

Figure 7:
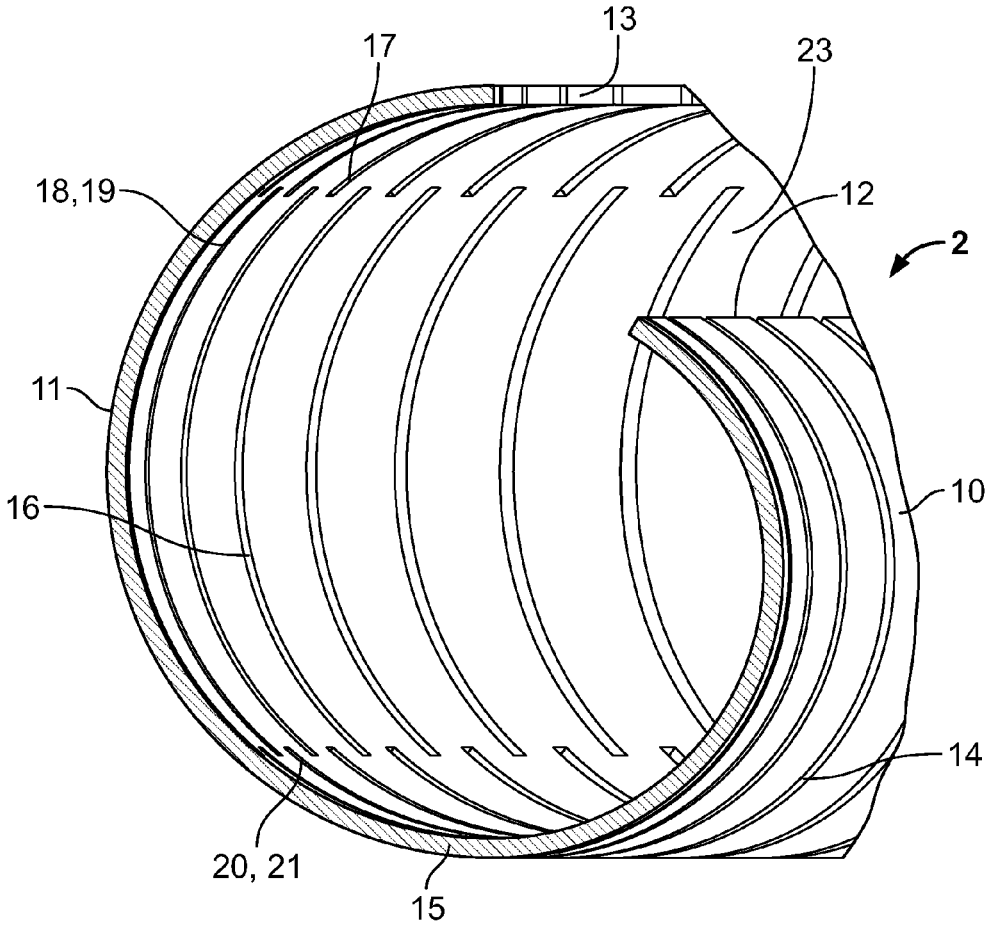
FIG. 7 is an enlarged partial illustration of the spring element.

FIG. 7 is an enlarged illustration of the first end 7 of the sleeve-shaped and circularly bent spring element 2 with the gap 23.

On an inner side 10 of a circle, the band-shaped spring element 2 is guided upward merely to just above the centre and ends with a first longitudinal edge 12, set apart by the gap 23, and below a second longitudinal edge 13. The second longitudinal edge 13 is guided into an upper region, preferably the top region of the cross section. The spring element 2 has a larger radius of curvature on an outer side 11 in cross section perpendicularly to the longitudinal axis 6 than on the inner side 10. On account of the smaller radius of curvature on the inner side 10 and the arrangement of the first longitudinal edge 12 below the second longitudinal edge 13, the first longitudinal edge 12 is pressed in the direction toward the opposing outer side 11 during compressing of the spring element 2, that is to say during the application of compressive forces on the inner side 10 and the outer side 11.

Formed on the inner side 10 are first slots 14 which are guided, starting from the longitudinal edge 12 to just above a lower summit 15, onto the outer side 11. Third slots 16 are formed on the outer side 11. The third slots 16 are guided from a lower region of the outer side 11 up to an upper region of the outer side 11. Second slots 17, which are guided up to the second longitudinal edge 13, are arranged in the upper region of the outer side 11. The first, second and third slots 14, 17, 16 each extend in planes lying perpendicular on the longitudinal axis 6. In a further embodiment, the first, second and/or third slots 14, 17, 16 can also extend transversely to the longitudinal axis 6.

Depending on the embodiment selected, upper end regions 18 of the third slots 16 preferably overlap with lower end regions 19 of the further second slots 17. Furthermore, lower end regions 20 of the third slots 16 preferably overlap with further lower end regions 21 of the first slots 14.

Figure 8:
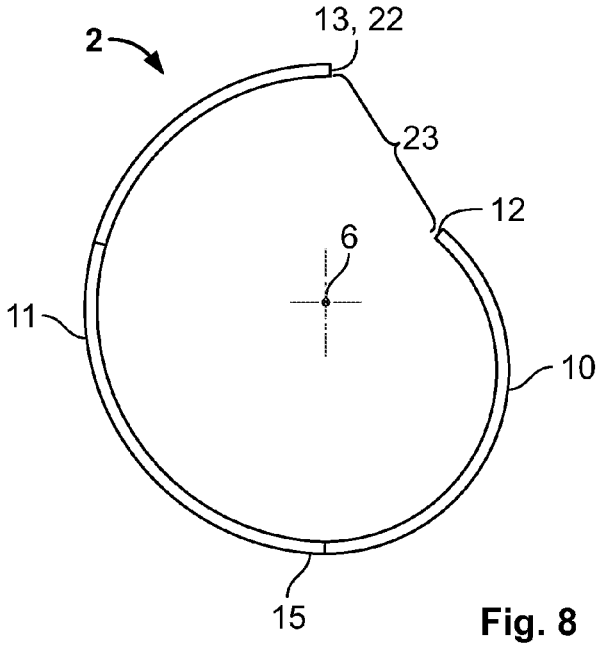
FIG. 8 is a cross section perpendicularly to the longitudinal axis onto the spring element.

FIG. 8 is a cross section perpendicularly to the longitudinal axis 6 of the spring element 2. In this case, it may clearly be seen that the second longitudinal edge 13 ends, in the illustrated exemplary embodiment, in the upper summit 22. The upper summit 22 is arranged opposing the lower summit 15. In the illustrated embodiment, the inner side 10 overlaps in an angular range of 35 degrees the centre between the upper and the lower summit, which centre is defined by the longitudinal axis 6. Furthermore, the inner side 10 has a smaller radius of curvature than the outer side 11. In addition, a gap 23, which is formed in an annular manner and is delimited by the spacing of the first and the second longitudinal edge 12, 13, is formed in the upper third of the inner side 10.

Figure 9:
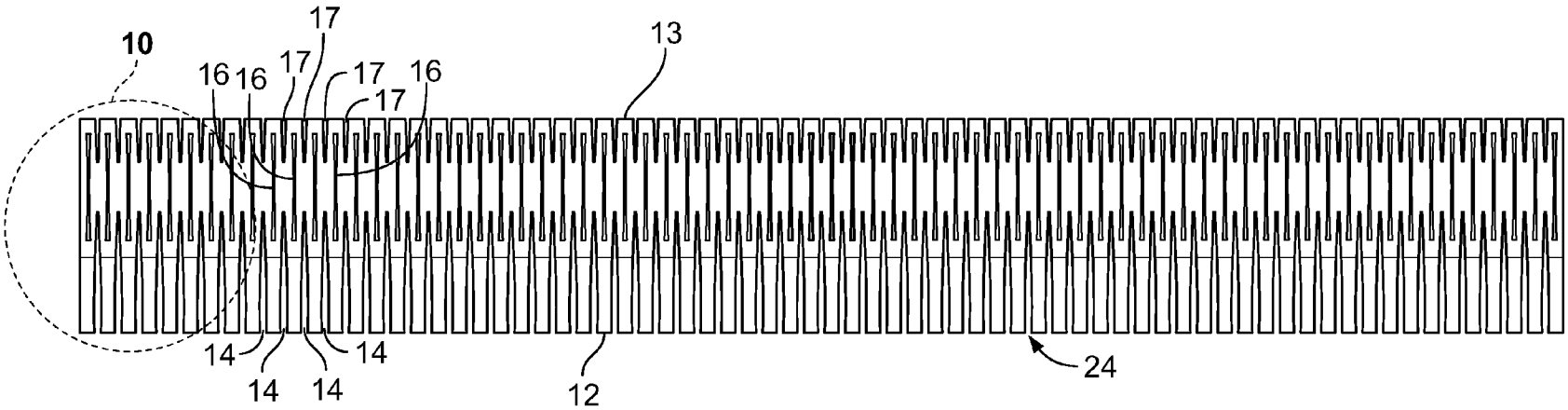
FIG. 9 shows a punched part for forming the spring element.

FIG. 9 shows an embodiment for a punched part 24 made from an electrically conductive and resilient material. The punching sheet 24 can for example be formed from spring steel. The punching sheet 24 has a rectangular shape, the first longitudinal edge 12 of the illustrated view being arranged at the bottom and the second longitudinal edge 13 being arranged at the top. A first series of first slots 14, which are arranged at equal spacings from one another, are formed in the punched part 24. Also formed is a second series of second slots 17 bordering the second longitudinal edge 13. Respective third slots 16 are arranged between each two adjacent first and between each two adjacent second slots 14, 17.

Figure 10:
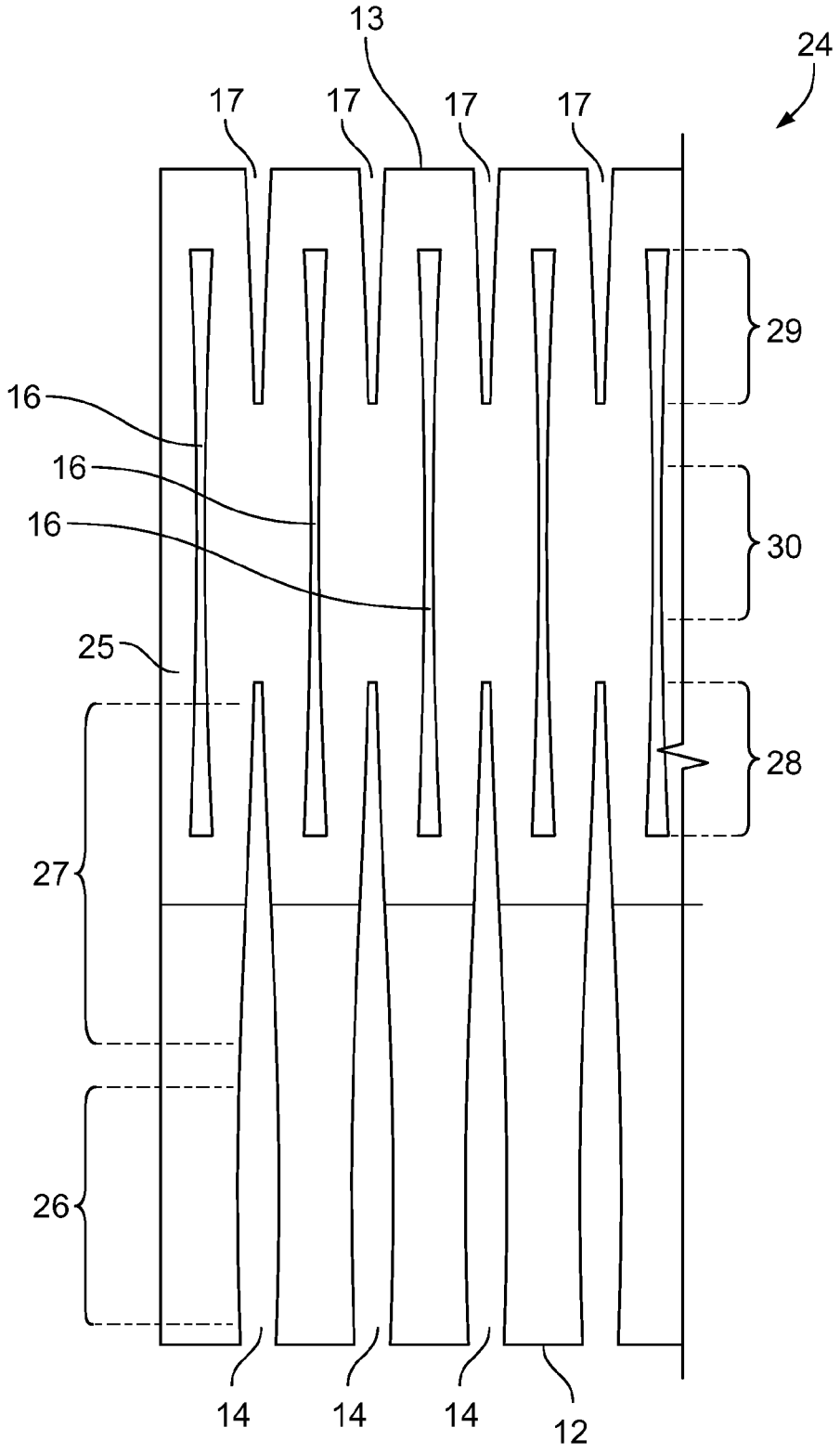
FIG. 10 is an enlarged illustration of the partial portion of the punched part.

FIG. 10 is an enlarged illustration of a portion of the punched part 24. In the illustrated embodiment, the first and the second slots are arranged at the same height and opposing one another. The second slots 17 emanate from the second longitudinal edge 13 having a starting width and extend in the direction toward the opposing first longitudinal edge 12 up to one quarter of the width of the punched part 24.

The first slots 14 emanate from the first longitudinal edge 12 and extend in a first portion 26 having increasing width in the direction toward the second longitudinal edge 13. The first portion 26 is for example guided up to one third of the width of the punched part 24. The first portion 26 is adjoined by a second portion 27 in which the width of the first slots 14 tapers. The second portion 27 is guided up to above a centre 25 of the punched part 24. The closed ends of the first and the second slots 14, 17, which oppose each other, are set apart from each other, the spacing being in the range of one third of the width of the punched part 24.

A third slot 16 is arranged between each two adjacent first slots 14 and the opposing two adjacent second slots 17. The third slot 16 overlaps in a first overlap region 28 with the adjacent first slots 14 and in a second overlap region 29 with the adjacent second slots 17. In the illustrated embodiment, the third slots 16 have a first width in the end regions, said third slots tapering in the direction toward a central region 30. In the central region 30, the width of the third slots 16 is constant.

The opening width of the first slots 14 at the first longitudinal edge 12 is larger than the opening width of the second slots 17 at the second longitudinal edge 13. Depending on the embodiment selected, the opening width of the first slots 14 in the region of the second longitudinal edge 13 can be more than three times as large as the opening width of the second slots 17 in the region of the second longitudinal edge 13.

Furthermore, the width of the first slots 14 is formed, up to a defined spacing in the direction toward the centre 25, for example up to one third of the total width of the punched part 24, so as to be wider than the wide end regions of the third slots 16.

In this way, the spring element 2 (see FIG. 3), which is bent circularly around the centre point 9 of the circle along the longitudinal axis 6, is embodied so as to be more flexible on the inner side 10 (see FIG. 6) than on the outer side 11. As a result, during plugging of the pin contact 1 into the socket contact 3, during which a force is exerted on the outer side 11 and the inner side 10 of the spring element 2, the inner side 10 is bent more intensively in the direction toward the outer side 11 than the outer side 11 is bent inward.

The central region 30 of the third slots 26 is positioned in around the longitudinal axis 6 rolled and with around the centre point 9 of the circle arched longitudinal axis 6 substantially in the central region of the outer side 11. Thus, although the annularly shaped spring element 2 is, as illustrated in FIG. 3, pliable in the region of the outer side 11 in the circular direction of the longitudinal axis 6, it is relatively stable in relation to a force acting perpendicularly on the outer side 11.

In addition, the greater width of the first slots 14 allows the punched part 24 to be bent, after the bending-over into a sleeve, into a ring, the first slots 14 being arranged on the inner side 10. As a result, it is possible to establish, using simple means, a narrower radius of curvature for the inner side 10 than for the outer side 11.

Depending on the embodiment selected, the punched part 24 has the longitudinal edges 12, 13 bent toward each other, thus producing a sleeve shape, the cross section is for example as illustrated in FIG. 8, the longitudinal axis 6 extending in the form of a straight axis. A correspondingly sleeve-shaped spring element 2 can for example be used in an arrangement according to FIG. 3.

If an annular or spiral-shaped spring element according to the embodiment of FIG. 4 is now to be produced, then the punched part, which is bent in a sleeve-shaped manner, is bent around a centre point 9 of a circle (FIG. 4), the first longitudinal edge 12 being arranged on the inner side 10. This provides an annular or spiral-shaped spring element 2 having in cross section an open sleeve shape perpendicularly to the arched longitudinal axis 6.

Depending on the embodiment selected, other shapes of recesses can also be provided instead of the first, second and third slots 14, 17, 16. In addition, the first, second and/or third slots can also have a simple rectangular contour having a constant slot width.

In a simple embodiment, the second slots 17 may for example be dispensed with.

It is possible to provide, instead of the described slots 14, 16, 17, recesses which increase the flexibility of the band, in particular of the circular or spiral structure from FIG. 3. In a simple embodiment, in which the spring element 2 is embodied merely as a rolled-up band having a straight longitudinal axis, the recesses, and in particular the first, second and third slots 14, 17, 16, may be dispensed with.

On account of the first and the third slots 14, 16, there are provided on the inner side 10 and on the outer side 11 a plurality of lamella strips which provide a plurality of contact points for electrically and/or mechanically contacting the pin contact and/or the socket contact. On account of the plurality of contact points, which are distributed uniformly over the outer radius and the inner radius of the spring element 2, a relatively uniform distribution of the contact normal force is achieved between the pin contact and the socket contact. This allows safe and uniformly distributed transmission of current between the pin contact and the socket contact. As a result of the advantageous form of the spring element from FIGS. 4 to 8, the spring element 2 is rotated about the longitudinal axis 6 of the spring element 2 when the pin contact is plugged into the socket contact. After a specific rotation, the spring element 2 is placed onto the inner contour of the groove 4, thus stabilising the mechanical or electrical connection between the pin contact and the socket contact.

The described spring element is suitable, as a result of the use of a punched part 14, for economical large-scale production. In addition, a uniform distribution of the transmitted current, and thus a uniform distribution of the heat produced, is achieved as a result of the large number of contact points on the inner side and the outer side of the spring element. The described spring element is particularly suitable for the use of plug connectors in which high currents have to be transmitted. In addition, the high elasticity of the spring element allows relatively large production tolerances between the outer contour of the pin contact and the inner contour of the recess of the socket contact to be compensated for. Relatively large spacings between the faces to be contacted can thus be bridged safely and reliably.

The invention claimed is:

1. Contact element with an electrically conductive spring element which is in contact with the contact element and which is provided to establish an electrical contact to a mating contact element wherein the spring element has the form of an open band which is at least partially rolled up along a longitudinal axis, wherein the spring element has recesses which increase the flexibility of the spring element, wherein the spring element has at least a first longitudinal edge with first slots which are guided toward the first longitudinal edge and end in an open manner at the first longitudinal edge, and wherein the spring element has at least an opposing second longitudinal edge with second slots which are guided toward the second longitudinal edge and end in an open manner at the second longitudinal edge, the second slots are formed so as to be shorter than the first slots.

2. Contact element according to claim 1, wherein the longitudinal axis is arranged in a straight or arched, in particular at least partially circular manner.

3. Contact element according to claim 1, wherein along the longitudinal axis third slots are formed between two successive first and/or second slots.

4. Contact element according to claim 3, wherein the third slots extend transversely over the spring element and overlap at end regions in each case with adjacent end regions of the first and/or second slots.

5. Contact element according to claim 3, wherein the third slots are formed so as to be wider in end regions than in a central region between the end regions.

6. Contact element according to one of claim 1, wherein the first slots, starting from an open region at the first longitudinal edge in the direction toward the second longitudinal side, increase in width in a first portion and subsequently decrease in width in a second portion.

7. Contact element according to claim 1, wherein the longitudinal axis is arched around a centre point of a circle, a first longitudinal edge having a spacing from the opposing second longitudinal edge, and a gap being arranged between the longitudinal edges on an inner side of the circular spring element.

8. Contact element according to claim 1, wherein a groove, in which the spring element is at least partially arranged, is provided on the contact element.

9. Plug-in connection to a contact element with a spring element according to claim 1, and a mating contact element, wherein the mating contact element rests against the spring element, and the spring element establishing an electrically conductive connection between the contact element and the mating contact element.

* * * * *